US005238762A

United States Patent [19]

Materazzi

[11] Patent Number: 5,238,762

[45] Date of Patent: Aug. 24, 1993

[54] LIQUID COLORED TONER COMPOSITIONS AND THEIR USE IN CONTACT AND GAP ELECTROSTATIC TRANSFER PROCESSES

[75] Inventor: Peter E. Materazzi, Southington, Conn.

[73] Assignee: Olin Corporation, Cheshire, Conn.

[21] Appl. No.: 765,625

[22] Filed: Sep. 25, 1991

Related U.S. Application Data

[63] Continuation-in-part of Ser. No. 657,012, Feb. 15, 1991, Pat. No. 5,116,705, which is a continuation-in-part of Ser. No. 498,785, Mar. 26, 1990, abandoned.

[51] Int. Cl.[5] ..... G03G 9/12

[52] U.S. Cl. ..... 430/45; 430/47; 430/114; 430/115

[58] Field of Search ..... 430/45, 47, 114, 115

[56] References Cited

U.S. PATENT DOCUMENTS

| | | | |
|---|---|---|---|
| 3,668,127 | 6/1972 | Machida et al. . | |
| 3,669,886 | 6/1972 | Kosel | 252/62.1 |
| 3,900,412 | 8/1975 | Kosel | 252/62.1 |
| 3,990,980 | 11/1976 | Kosel | 252/62.1 |
| 3,993,483 | 11/1976 | Maki et al. | 96/1 LY |
| 4,181,620 | 1/1980 | Tsubuko | 430/114 |
| 4,360,580 | 11/1982 | Tsubuko et al. | 430/137 |
| 4,378,422 | 3/1983 | Landa et al. | 430/111 |
| 4,507,377 | 3/1985 | Alexandrovich . | |
| 4,575,478 | 3/1986 | Ohno . | |
| 4,661,431 | 4/1987 | Bujese | 430/126 |
| 4,732,831 | 3/1988 | Riesenfeld et al. | 430/60 |
| 4,734,352 | 3/1988 | Mitchell | 430/115 |
| 4,760,009 | 7/1988 | Larson | 430/137 |
| 4,786,572 | 11/1988 | Haku et al. | 430/60 |
| 4,786,576 | 11/1988 | Bujese et al. | 430/126 |
| 4,789,616 | 12/1988 | Croucher et al. | 430/109 |
| 4,794,651 | 12/1988 | Landa et al. . | |
| 4,798,778 | 1/1989 | El-Sayed et al. | 430/115 |
| 4,812,377 | 3/1989 | Wilson et al. | 430/109 |
| 4,855,207 | 8/1989 | Tsubuko et al. . | |
| 4,925,766 | 5/1990 | Elmasry et al. . | |
| 4,946,753 | 8/1990 | Elmasry et al. | 430/45 |
| 4,971,883 | 11/1990 | Chan et al. | 430/114 |
| 4,978,598 | 12/1990 | Elmasry et al. . | |
| 4,988,602 | 1/1991 | Jongewaard et al. . | |

FOREIGN PATENT DOCUMENTS

| | | |
|---|---|---|
| 0243934 | 4/1987 | European Pat. Off. . |
| 0252735 | 1/1988 | European Pat. Off. . |
| 2313547 | 3/1973 | Fed. Rep. of Germany . |
| 50-32624 | 10/1975 | Japan . |
| 6076755 | 10/1983 | Japan . |
| 5428629 | 12/1987 | Japan . |
| 1563240 | 3/1980 | United Kingdom . |

*Primary Examiner*—Marion E. McCamish
*Assistant Examiner*—S. Rosasco
*Attorney, Agent, or Firm*—William A. Simons

[57] ABSTRACT

A liquid colored electrostatic toner comprising:

(A) a colored predispersion comprising (1) a nonpolymeric resin material having certain insolubility (and nonswellability), melting point, and acid number characteristics; (2) a polymeric plasticizer having certain insolubility (and nonswellability) and melting point characteristics; and (3) colorant material having certain particle size characteristics; and (B) an aliphatic hydrocarbon liquid carrier having certain conductivity, dielectric constant, and flash point.

14 Claims, No Drawings

LIQUID COLORED TONER COMPOSITIONS AND THEIR USE IN CONTACT AND GAP ELECTROSTATIC TRANSFER PROCESSES

CROSS-REFERENCES TO RELATED APPLICATIONS

This patent application is a continuation in part application of U.S. patent Ser. No. 07/657,012, filed on Feb. 15, 1991 that issued as U.S. Pat. No. 5,116,705 on May 26, 1992 with Peter E. Materazzi as the named inventor which is a continuation in part application of U.S. patent Ser. No. 07/498,785, filed on Mar. 26, 1990 now abandoned with Peter E. Materazzi as the named inventor. Both of these applications are incorporated herein by reference in their entireties.

BACKGROUND OF THE INVENTION

1. Field of the Invention

The present invention relates to a liquid colored toner composition suitable for use in contact and gap electrostatic transfer processes. The present invention further relates to a liquid colored toner composition which comprises a mixture of a carrier liquid and a colored predispersion which is made by mixing together at least one selected nonpolymeric resin material, at least one selected polymeric plasticizer, and at least one selected colorant material. 2. Brief Description of the Prior Art Liquid toner compositions for use in developing latent electrostatic images are well-known in the art. Additionally, liquid toner compositions suitable for use in contact electrostatic transfer processes, as well as liquid toner compositions suitable for use in gap electrostatic transfer processes, are documented in the patent literature. In the contact electrostatic transfer process, a toned image is formed on a suitable photoreceptor after which the toned image is brought into contact with a receiver substrate such as paper. An electrostatic potential opposite in polarity of the toner is applied to the receiver substrate (usually by use of a corona) which causes transfer of the toner from the photoreceptor to the receiver substrate. Some commercial examples of this process are the Ricoh and Savin plain paper liquid copiers.

The gap electrostatic transfer process is generally similar to contact transfer except the receiver substrate does not contact the photoreceptor. Instead, it is physically separated by an 0.5 to approximately 10 mil gap. This gap can be filled with carrier liquid or air. Two different approaches to this process are described by Landa (U.S. Pat. No. 4,378,422) and by Bujese (U.S. Patent No. 4,786,576). The liquid toner requirements for contact and gap electrostatic transfer are quite similar.

Most of the early liquid toner patent literature relates to toners intended for use in relatively low quality black and white copiers. While many of these disclosures are suitable for their intended purposes, most are clearly unacceptable for use in high quality color imaging.

Many recent patents have issued which describe liquid toners intended for high quality color imaging. Many of these toners can be used in contact and gap electrostatic transfer processes. While most of these later toners are superior to those in the early black and white toners, many problems still remain. Specifically, concerning liquid toners intended for contact or gap electrostatic transfer multicolor imaging processes, there remains a need for toners which possess all of the following properties:

(a) Charge properties which are independent and unaffected by pigment choice

Adverse charging effects from pigments is, perhaps, the greatest source of trouble for the liquid toner formulator. Pigments are usually heterogeneous materials containing substantial amounts of impurities in addition to post-added dispersants and flow agents. Different pigments vary considerably in their composition of these compounds, and even batch-to-batch variations can be quite significant. Reducing, or eliminating, the charging effects due to these compounds is a major first step in designing charge stable toners. It is important to use charge stable toners for multicolor imaging in order to achieve and maintain color balanced imaging. There are a number of recent liquid toner patents which attempt to address the problem of charge stability Most relate to specific charge directors, and/or specific charge adjuvants, and generally avoid the issue of solving the pigment problem. Charge independence from pigments gives an added benefit of allowing different color toners to be formulated having the same charge and imaging properties. These toners can be blended to a desired shade and used in a color-matching system, such as the PANTONE color-matching process which is popular in the printing ink industry. Different color toners, which have similar charging and imaging properties, will hereafter be called "colorblind" toners. It has been found that certain toners containing particles which are not swellable in the liquid carrier may be made colorblind.

(b) High transparency

This property is generally achieved by mechanically reducing pigment agglomerates down as close as possible to the primary pigment particle size, around 0.05 to 0.5 microns, and dispersing the particles as homogeneously as possible. A means must be present to keep the pigment particles from re-agglomerating. This is usually achieved by dispersing the pigment particles in a rigid or semirigid resin binder, although steric stabilization in solution can also be used. It has been found that it is extremely difficult to disperse substantial amounts of pigments (i.e, $\geqq 10$ wt. %) down to their primary particle sizes in most of the common polymeric binders used in previous liquid toners. Examples of these types of binders include polystyrenes, polymethylmethacrylates, polyesters, and polyvinyl acetates. In addition, virtually all crystalline waxes and crystalline homopolyethylene resins, which are very popular in the black and white toner art, are not transparent and, thus, cannot be used in substantial amounts in color toners. Also, mixing two transparent resins together which are not soluble in each other will usually result in a hazy, nontransparent composite. The above limitations further limit the choice of suitable resin binders for high quality color toners.

(c) Ability to replenish developer bath using high-solids concentrate

This issue is rarely addressed, if ever, in the liquid toner patent literature. However, it is very important when considering medium to high speed multicolor printing.

For example, take the case of when more than a hundred $8.5 \times 11$ inch four-color prints per minute are being made. The page coverage can range from 0 to 400% with 100 to 200% coverage being common. A substantial amount of toner may be consumed. To illustrate the problem, consider printing an 8½×11 inch image at 80% coverage, wherein the weight of toner solids applied per page was 0.167 grams and the printing rate was 200 pages per minute. Then the amount of toner concentrate and Isopar® carrier liquid used per hour would be as shown in Table below:

| | Toner Usage | |
|---|---|---|
| % of Solids in Liquid Toner | Gallons of Toner Conc. Per Hour | Gallons of Isopar Solvent Per Hour |
| 10 | 7.14 | 6.43 |
| 20 | 3.57 | 2.86 |
| 30 | 2.38 | 1.67 |
| 40 | 1.79 | 1.07 |

Clearly, the data in this table shows that a high solids concentrate replenishment is very beneficial because less gallons of toner concentrate and less gallons of Isopar liquid carrier will be used. Most of the liquid toners suitable for contact, or gap, electrostatic transfer, described in the literature, are made with carrier liquid swelled particles which tend to gel heavily around 20% solids. Most of these toners are not acceptable for use in a high solids replenishment system. It has been found that liquid toners, of the present invention, which contain hard and nontacky particles that are not swelled by the carrier liquid in the 0.5 to 10 micron particle size range can be made free flowing even at a high solids content. These toners of the present invention are acceptable for use in contact, or gap, electrostatic transfer processes.

(d) Ability to produce high resolution images

High quality, multicolor half-tone imaging generally requires the ability to image greater than 5 to 95% half-tone dots using a 150 line screen ruling along with at least a 10 micron limiting resulting resolution. Toner image spread also needs to be reduced or eliminated to avoid excess dot gain. Many recent liquid toner patents describe various additives and preferred embodiments designed to achieve this desired result. The toners disclosed in this invention achieve the above criteria by using hard, compression-resistant resin particles in a particular particle size range.

(e) Good transfer properties

The toners of the present invention have transfer properties suitable for use with both contact and gap electrostatic transfer processes.

3. Discussion of Possible Relevant References

Machida et al. (JP-50-32624) describes a liquid developer for electrostatic photography transfer which contains a liquid carrier; pigments or dyes; resins which are insoluble in liquid carrier and are either nonswellable or swellable in the liquid carrier; plasticizers which are insoluble in carrier liquid and have a high dielectric constant and low electrical resistance. Isopar G or H are among the liquid carriers disclosed. Carbon black and other pigments and dyes are disclosed. The disclosed class of nonswellable resins include Pentalyn H which is a maleic-modified rosin. Disclosed plasticizers include dimethyl phthalate, n-butanol, methylethyl ketone, ethylene glycol and polyester plasticizers, among others. All of the plasticizers disclosed in this Japanese kokai flow or are liquid at room temperature (20°-30° C.). The reference teaches alternate methods for making their liquid developers. One method disclosed is to knead the pigment or dye, the resin or resins and the plasticizer together in roll mill. This mixture is combined with liquid carrier to form microgranules in a ball mill or jet mill. The resultant microgranules are dispersed in more liquid carrier. The resultant dispersion is ground to the desired particle size in a ball mill or colloid mill or the like in order to make concentrated liquid developer, The concentrate is diluted with more carrier liquid to obtain desired solids content for machine use. More plasticizer may be added during the dilution step. One disadvantage is that the liquid or flowable plasticizer can render the toner particles tacky and will not flow easily in high solids concentration.

Maki et al. (U.S. Pat. No. 3,993,483) describes liquid electrostatic transfer toners which contain at least one compound of Group (A) and a least one compound of Group (B). Group (A) compounds include rosin modified phenol resin, rosin modified maleic acid resin, and rosin modified pentaerythritol. Group (B) compounds include low molecular polyethylene, ethylene ethylacrylate copolymers, ethylene vinylacetate copolymer, and low molecular polypropylene. The ratio of compound A to B varies from 100:60 to 100:400. The toners are prepared simply by ball milling the above together with a colorant and an aromatic carrier liquid (e g., Solvesso 100), usually at an elevated temperature. These toners of Maki et al. are not acceptable for high quality color printing for the following reasons:

First, the pigments are directly exposed to the carrier liquid which eliminates the colorblind property. Second, the binders, particularly the (B) components, are substantially swelled with the carrier liquid and will gel at a high solids content. High solids replenishment is not possible.

Machida et al. (U.S. Pat. No. 3,668,127) describes liquid toners characterized as having pigment particles coated with a resinous layer consisting of at least two layers of which the first or inner resin layer is directly coated on the pigment particles and is comprised of a resin which is insoluble in the carrier liquid while the outermost layer comprises a resin capable of somewhat swelling in the carrier liquid. Resins disclosed for the first layer include styrene-butylmethacrylate (7:3), styrene-lauryl methacrylate (9:1), methylmethacrylate-butylmethacrylate, among others. Resins suitable for the swelled layer include styrene-lauryl methacrylate (1:1) and styrene-butylmethacrylate-acrylic acid (3:7:1), among others. The use of modified natural rosins as such binder resins and the use of plasticizers are not taught. The patentees claim that encapsulating the pigments in this manner gives improved charge stability, gives uniform charge, and reduces background staining. This might appear to be a good way to make a colorblind liquid toner. However, as the toner particles settled, they would form a solid mass. As such, the disclosed toners are not suitable for high solids replenishment.

Tsubuko et al. (U.S. Pat. No. 4,360,580) describes liquid developers suitable for contact electrostatic transfer which are prepared by blending in the carrier liquid:

(1) a resin dispersion A comprising a polymer obtained from at least one kind of resin which is difficult to dissolve, or insoluble, in the carrier liquid and at least one kind of monomer which is soluble in said resin; and (2) a pigment coated with resin B which is different than resin dispersion composition A and is substantially insoluble in the carrier liquid.

Dispersion A is made by polymerizing, for example, lauryl methacrylate in the presence of a natural rosin or modified natural rosin. It acts as a dispersant for the colored B composition. Resins cited for component B include natural rosins and modified natural rosins. Pigments are kneaded into the B resin before dispersing with component A. Optionally, a charge controlling monomer, such as acrylic acid, may be polymerized in the presence of resin B and the pigments during the kneading process. The patentees claim improved polarity controlling ability, improved storage stability, and improved transfer property. The incorporation of plasticizers is not taught. Also, the term "substantially insoluble" is not defined. Many of the cited resins for use in component B are known to swell and/or dissolve somewhat in the carrier liquid. In addition, many of the resins cited for component B have softening points above 100° C. In this case, poor image fusing would be expected unless the particles were swelled and plasticized by the carrier liquid. These disclosed toners have not demonstrated the colorblind property and probably cannot be used in a high solids replenishment system.

Several other liquid electrostatic toner patents have issued which describe coating the pigments with so-called carrier nonsoluble natural rosins or modified natural rosins. None of these approaches have been successful in achieving all the criteria needed for high quality color imaging using the contact, or gap, electrostatic transfer processes. Not surprisingly, most recent color liquid toner work has concentrated on using man-made polymeric binders, particularly polyesters and polyethylenes.

Alexandrovich (U.S. Pat. No. 4,507,377) describes liquid toners comprised of a compatible blend of at least one polyester resin and at least one polyester plasticizer. The resin and plasticizer are dissolved in an aromatic solvent and ball milled together with pigments and a dispersant to produce a concentrated dispersion. The concentrate is next diluted in the carrier liquid where the resin and plasticizer precipitate out of solution and coat the pigments. This patent teaches the importance of selecting compatible binder components in order to achieve high transparency. Compatible means that the components are soluble in each other and remain clear and transparent when mixed together. This patent also teaches the importance of using a plasticizer which is not soluble in the carrier liquid. One big disadvantage in this disclosure is the use of an aromatic solvent in making the concentrated dispersion. The pigments are exposed to this aromatic solvent during the dispersion step which adversely affects the colorblind property.

Wilson et al. (U.S. Pat. No. 4,812,377) describes specific polyester resins which are suitable for liquid or dry toners. In this patent, the pigments are kneaded into the resin prior to ball milling in the carrier liquid. The patentees mention that these particular resins are brittle and can be easily ground to small particle sizes. Additionally, the patentees claim good pigment dispersing ability with these resins.

Landa et al. (U.S. Pat. No. 4,794,651) and Larson (U.S. Pat. No. 4,760,009) describe polyethylene-based liquid toners which are prepared, for example, by:

(1) heating the polyethylene resin and pigment in the carrier liquid to plasticize and dissolve the resin;

(2) ball milling the mixture, at an elevated temperature, to finely disperse the pigments; and (3) cooling the mixture, with or without grinding, to precipitate the resin onto the pigment particles.

When cool, the diluted composition contains toner particles which are somewhat swelled and plasticized by the carrier liquid. The toner particles have a fiberous structure which reduces compressibility during contact electrostatic transfer and also improves transfer efficiency. These toners have demonstrated the capability of producing high quality color images in certain contact electrostatic transfer processes. However, recently a large number of patents have been issued (mostly to DuPont) which describe specific charge directors and/or charge adjuvants intended to improve these toners. The data in these patents indicate that the imaging properties of these toners are very dependent upon the pigments used. The colorblind property has not been demonstrated and charge stability may be a problem. Also, these polyethylene-based toners tend to gel heavily at a high solids content making them unsuitable for use in a high solids replenishment system.

Other U.S. patents which ar directed to liquid electrostatic toners, which might be relevant to the present invention, include the following:

Kosel (U.S. Pat. No. 3,900,412) teaches a liquid toner having dispersion phase of pigments in a liquid hydrocarbon system. The toner contains an amphipathic polymeric molecules composed of two moieties. One moiety being a dispersant and a fixative to bond the molecules to a substrate, while the second moiety has a very small particle size. The first part of the amphipathic polymeric being dissolved in the liquid hydrocarbon system, while the second part being in the pigment phase.

Landa et al. (U.S. Pat. No. 4,378,422) discloses a gap electrostatic imaging process which uses a developing liquid comprising an insulating carrier liquid and toner particles.

Riesenfeld et al. (U.S. Pat. No. 4,732,831) teaches a liquid electrostatic master which contains a combination of specific polymeric binder, an ethylenically unsaturated photopolymerizable monomer, a specific chain transfer agents, and specific stabilizer.

Mitchell (U.S. Pat. No. 4,734,352) teaches liquid electrostatic developer containing (a) a nonpolar liquid carrier; (b) thermoplastic resin particles having an average by area particle size of less than 10 microns; (c) an ionic or zwitterionic compound soluble in said nonpolar liquid carrier; and (d) a polyhydroxy compound.

Bujese et al. (U.S. Pat. No. 4,786,576) teaches a liquid electrostatic toner containing an alcohol insoluble maleic modified rosin ester and an ethylene-ethylacrylate copolymer.

Croucher et al. (U.S. Pat. No. 4,789,616) teaches a liquid electrostatic toner containing a dyed polymer and amphipathic stabilizer.

El-Sayed et al. (U.S. Pat. No. 4,798,778) teaches a positive-working liquid electrostatic developer containing (a) nonpolar liquid carrier; (b) thermoplastic resin which is an ethylene homopolymer having a carboxylic acid substituent or a copolymer of ethylene and another monomer having a carboxylic acid substituent; and (c) ionic or zwitterionic compound which is soluble in said nonpolar liquid carrier.

Tsubuko et al. (U.S. Pat. No. 4,855,207) teaches wet-type electrostatic developers containing colorant particles coated with an olefin resin having a melt index of 25–700 g per 10 minutes, measured under a load of 2,160±10 g. at 190°±0.4° C.

Elmasry et al. (U.S. Pat. Nos. 4,925,766 and 4,978,598) teaches liquid electrophotographic toners containing chelating copolymer particles comprised of a thermoplastic resinous core with a Tg below room temperature, which is chemically anchored to an amphipathic copolymer steric stabilizer which is soluble in the liquid carrier solvent and has covalently attached thereto moieties of a coordinating compound and at least one metal soap compound.

Elmasry et al. (U.S. Pat. No. 4,946,753) teaches liquid electrophotographic toners wherein the toner particles are dispersed in a nonpolar carrier liquid and wherein (a) the ratio of conductivities of the carrier liquid to the liquid toner is less than 0.6 and (b) the zeta potential of said toner particles is between +60 mV and +200 mV.

Chan et al. (U.S. Pat. No. 4,971,883) teaches a negative-working electrostatic liquid developer containing (a) nonpolar liquid carrier; (b) particulate reaction product of a polymeric resin having free carboxyl groups and a specific metal alkoxide; and (c) ionic or zwitterionic charge director compound soluble in the nonpolar liquid carrier.

Jongewaard et al. (U S. Pat. No. 4,988,602) teaches liquid electrophotographic toners containing chelating copolymer particles dispersed in a nonpolar carrier liquid, said chelating copolymer particles comprising (a) a thermoplastic resin core having a Tg of 25° C. or less and is insoluble or substantially insoluble in said carrier liquid and is chemically anchored to an amphipathic copolymer steric stabilizer containing covalently attached groups of a coordinating compound which in turn are capable of forming covalent links with organic-metallic charge directing compounds and (b) a thermoplastic ester resin that functions as a charge enhancing component for the toner. The preferred thermoplastic resins are those derived from hydrogenated rosin having an acid number between 1 and 200, a softening point in the range of 70° C. to 110° C. and being soluble in aliphatic hydrocarbon solvents.

BRIEF SUMMARY OF THE INVENTION

Accordingly, the present invention is directed to a liquid colored toner composition comprising:

(a) a colored predispersion comprising a homogeneous mixture of at least one nonpolymeric resin material, at least one polymeric plasticizer, and at least one colorant material;
  (1) said nonpolymeric resin material which is characterized by:
    (aa) being insoluble and nonswellable in the liquid carrier;
    (bb) having a melting point between 60° to 180° C.; and
    (cc) having an acid number higher than about 100;
  (2) said polymeric plasticizer characterized by:
    (aa) being soluble in said nonpolymeric resin;
    (bb) being insoluble in the liquid carrier; and
    (cc) having a melting point from about 35° C. to about 70° C.; and
  (3) said colorant material having an average primary particle size of less than about 0.5 microns;

and wherein said colored predispersion contains about 50% to about 98.5% by weight nonpolymeric resin; about 1% to 20% by weight polymeric plasticizer; and 0.5% to 30% by weight colorant material; and (b) an aliphatic hydrocarbon liquid carrier having a conductivity of $10^{-9}$ MHOS/$_{cm}$ or less, a dielectric constant of 3 or less, and a flash point of 100° F. or greater;

wherein said toner containing about 0.1% to about 10% by weight colored predispersion and about 99.9% to about 90% by weight of said liquid carrier and said colored predispersion particles having about 0.5–10 micron average particle size and being insoluble and nonswellable in said liquid carrier.

DETAILED DESCRIPTION

The colored predispersion of the toners of the present invention are comprised of three critical ingredients, namely, (A) a nonpolymeric resin; (B) a polymeric plasticizer; and (C) a colorant agent.

As stated above, the nonpolymeric resin used in the liquid toner of the present invention must possess a specific combination of insolubility (and nonswellability), melting point and acid number characteristics. First, the nonpolymeric resin should be insoluble and nonswellable in the carrier liquid because during the colored predispersion step, the nonpolymeric resin encapsulates the colorant agents and the charge properties associated with the pigments. Thus, the majority of the colorant agent is never exposed directly to the carrier liquid. It is locked within or covered with the nonpolymeric resin which is insoluble and nonswellable in the liquid carrier. "Insoluble in the liquid carrier", as used herein for the nonpolymeric resin, means that less than 1%, preferably less than 0.5% by weight, of the nonpolymeric resin will dissolve in the liquid carrier.

"Nonswellable in the liquid carrier", as used herein for the nonpolymeric resin, means that nonpolymeric resin will not increase in weight more than about 25% by absorption after contacting with the liquid carrier at room temperature followed by removing all free liquid carrier from the nonpolymeric resin.

As stated above, the melting point of the nonpolymeric resin should be between about 60° and 180° C. Preferably, the melting point should be between about 70° and 150° C. The melting point is determined by the ring and ball method.

The acid number should be greater than 100. Acid number means the amount of KOH in mg needed to neutralize 1 gram of resin.

Preferably, the nonpolymeric resin should possess other properties. It should preferably have a Gardner color index of 11 or less. It should preferably be friable enough at room temperature to easily grind to a small particle size using conventional ball milling equipment, for example, an S-1 type attritor. It should preferably have excellent pigment dispersing properties even in the absence of a liquid such as the liquid carrier. They should preferably be easy to use in conventional compounding equipment, for example, a compounding twin-screw extruder. Preferably, the nonpolymeric resin is completely soluble (i.e., forms a clear, nonhazy solution containing no visible precipitates) in ethanol or diethylene glycol at a 1 to 50 wt. % solids loading. Preferably, the nonpolymeric resin is not soluble in water or in mineral spirits (i.e., a mixture of aliphatic, aromatic, or naphthenatic hydrocarbon liquids having a Kauri-Butanol value of 30 to 50) at a 1 to 50 wt. % solids loading.

The most suitable materials for the nonpolymeric resin (A) are maleic modified rosins having acid numbers of 100 or greater. These are also sometimes called "rosin modified maleic acid resins". These include rosins modified with maleic anhydride, maleic and/or fumaric acid, or mixtures thereof. These rosins are chemically modified forms of natural wood rosin, gum rosin, or tall oil rosin. Natural rosins consist of approximately 90% resin acids which are mostly abietic acid or its related isomers and about 10% neutral resins with most structurally similar to abietic acid. Abietic acid contains both a reactive monocarboxylic acid functionality and, also a reactive diene structure. In the maleic modified rosins suitable for this invention both functionalities may be reacted as follows:

1. The diene structure is reacted with maleic anhydride, maleic acid, or fumaric acid by Diels-Alder reaction. Increasing the reacted amount of maleic anhydride or fumaric acid increases the acid number of the rosin. Increasing the acid number in this manner also further increases the melting point, gloss, and hardness properties.

2. Next, some of the acid groups are esterified with a suitable polyalcohol—examples include pentaerithritol, di- and tri-pentaerithritol, mannitol, sorbitol, among others. This esterification links also tends to increase the melting point, hardness, and gloss properties.

Examples of acceptable nonpolymeric maleic modified rosins suitable for component (A) include:

| | Manufacturer | Acid No. | M.P. °C. |
|---|---|---|---|
| Unirez 709 | Union Camp | 117 | 115 |
| Unirez 710 | " | 300 | 145 |
| Unirez 757 | " | 115 | 130 |
| Unirez 7019 | " | 250 | 135 |
| Unirez 7020 | " | 110 | 130 |
| Unirez 7024 | " | 235 | 120 |
| Unirez 7055 | " | 193 | 155 |
| Unirez 7057 | " | 123 | 125 |
| Unirez 7080 | " | 133 | 115 |
| Unirez 7083 | " | 235 | 111 |
| Unirez 7089 | " | 110 | 125 |
| Unirez 7092 | " | 188 | 135 |
| Unirez 7093 | " | 215 | 135 |
| Pentalyn 255 | Hercules | 196 | 171 |
| Pentalyn 261 | " | 205 | 171 |
| Pentalyn 269 | " | 200 | 177 |
| Pentalyn 856 | " | 140 | 131 |
| Pentalyn 821 | " | 201 | 150 |

There are many other chemically modified rosin materials cited in the prior art. Many of these rosins are often cited as being carrier liquid insoluble in the patent literature. However, none of these other rosins meet all our criteria for component (A), and most actually swell and/or dissolve into the carrier liquid. Examples of these resins, which are not acceptable for use in component (A), include natural rosin, rosin esters, hydrogenated rosin, hydrogenated rosin esters, dehydrogenated rosins, polymerized rosin esters, phenolic modified rosins and rosin esters, and alkyl modified rosins.

While maleic modified rosins having acid numbers of 100 or greater are the preferred resins for use as component A, it is anticipated that other nonpolymeric resins which meet the criteria outlined previously may also be used.

The second critical component of the colored predispersion is a polymeric plasticizer (C) which is defined as having the following properties:

1. Soluble in the nonpolymeric resin. Soluble means that at a temperature above their melting points the polymeric plasticizer will completely dissolve into the nonpolymeric resin.
2. Insoluble in the liquid carrier. The phrase "insoluble in the liquid carrier", as used herein for the polymeric plasticizer, means that less than 1%, preferably less than 0.1% by weight, of the polymeric plasticizer will dissolve in the liquid carrier.
3. A melting point not less than 35° C. and not greater than 70° C.

The plasticizer suitable for use in the toner composition of this invention should also be compatible with the nonpolymeric resin and colorant.

We have found that the most preferred materials for the polymeric plasticizer (B) are polyethylene glycols with molecular weights ranging from about 1,000 to about 10,000. Other medium to high molecular weight polyols, such as polyethylene oxide and polyethylene glycol methyl ether, may also be used. Specific examples include:

| Compound | M.W. | Melt Temp. (C.) | Viscosity (210° F.) CPS |
|---|---|---|---|
| Polyethylene Glycol | 1,000 | 39 | 17.4 |
| " | 1,500 | 45 | 28.0 |
| " | 2,000 | 49 | 56.0 |
| " | 3,400 | 55 | 90.0 |
| " | 8,000 | 62 | 800.0 |
| " | 10,000 | 63 | 870.0 |
| PEG Methyl Ether | 2,000 | 52 | 54.6 |
| " | 5,000 | 59 | 613.0 |
| Polyethylene Oxide | 100,000 | 66 | — |

These compounds meet the criteria for solubility properties, nonpolymeric resin compatibility, and suitable melting temperatures. In addition, these compounds are ideal because they exhibit very sharp melt points, at which temperatures the viscosity drops dramatically. In other words, these compounds become low viscosity solvents when heated only a couple of degrees above their melting temperatures. This property greatly decreases the fusing temperatures of the disclosed toners and, also, is used to ensure that a smooth, even film is formed on the toned image after fusing. This allows for the use of high melting point nonpolymeric resins which do not swell in the liquid carrier. At room temperature, these polymeric plasticizers are hard, wax-like materials which are not tacky. This is unlike most other known plasticizers. This property enables the toner particles of the present invention to be very hard, friable, and nontacky at room temperature. Surprisingly, even though these polymeric plasticizers are solids at room temperature, it has been found that they greatly improve the flexibility and crack resistance of the fused toned images. It is believed that it is the polymeric nature of these plasticizers which gives us this property.

The third critical component of the colored predispersion is one or more colorant agents (C). These are preferably dry organic or inorganic pigments or dry carbon black. Resinated pigments may also be used, provided the resins meet the criteria for component (A) above. Solvent dyes which are soluble in alcohols or glycols and insoluble in aliphatic hydrocarbon solvents may also be used.

Most common organic pigments may be used in the composition of this invention. The pigments are used in amounts of from about 0.5 to about 30%, preferably from about 5 to about 15% by weight solids in the toner. Pigments suitable for use herein include copper phthalocyanine blue (C.I. Pigment Blue 15), Victoria Blue (C.I. Pigment Blue 1 and 2), Alkali Blue (C.I. Pigment Blue 61), diarylide yellow (C.I. Pigment Yellow 12, 13, 14, and 17), Hansa yellow (C.I. Pigment Yellow 1, 2, and 3), Tolyl orange (C.I. Pigment Orange 34), Para Red (C.I. Pigment Red 1), Naphthol Red (C.I. Pigment Red 2, 5, 17, 22, and 23), Red Lake C (C.I. Pigment Red 53), Lithol Rubine (C.I. Pigment Red 57), Rhodamine Red (C.I. Pigment Red 81), Rhodamine Violets (C.I. Pigment Violet 1, 3, and 23), and copper phthalocyanine green (C.I. Pigment Green), among many others. Many of these pigments are used in Examples 7 to 42, presented herein. Inorganic pigments may also be used in the toner composition of this invention. These include carbon black (C.I. Pigment Black 6 and 7), chrome yellow (C.I. Pigment Yellow 34), iron oxide (C.I. Pigment Red 100, 101, and 102), and Prussian Blue (C.I. Pigment Blue 27), and the like. Solvent dyes may also be used, provided they are insoluble in the carrier solvent and soluble in the binder resin. These are well-known to those skilled in the art.

The nonpolymeric resin (A), polymeric plasticizer (B), and colorant (C) are preferably mixed and kneaded together by heating the mixture at or above the melting temperatures of the nonpolymeric resin and plasticizer and compounding the mixture under high sheer and pressure forces. A twin-screw compounding extruder is preferred; however, other kneading equipment known in the art, such as a Banbury, three roll mill, and the like, may also be used. The purpose of this preferred kneading step is to (1) completely dissolve the polymeric plasticizer (B) into the nonpolymeric resin (A); and (2) completely and homogeneously disperse the colorants (C) into the nonpolymeric resin (A) and the polymeric plasticizer (B). Organic pigments should ideally be broken down to their primary particle sizes after which each pigment particle is completely wetted and coated by the resin and plasticizer mixture. This ensures that maximum color strength and transparency is achieved.

After the resin (A), plasticizer (B), and colorants (C) are fully kneaded and cooled, a small sample is usually checked to ensure that the dispersion is complete. This can be checked by preparing a thin film coating of the blend, for example, by smearing a small piece on a hot microscope slide and viewing the thin film under a visible microscope. Most organic pigments have average primary particle sizes in the 0.05 to 0.5 micron range which is too small to readily see in most optical microscopes. Compounding is complete when the sample has a smooth, even color. Small amounts of large, visible particles are generally acceptable. However, large amounts of visible particles, or a grainy appearance, means that the kneading process is not complete and must be repeated. It is important that the kneading step be done in the absence of any solvent or the colorblind property may be lost.

After the kneading step, the blend is usually broken into a coarse powder (about 100 micron particle size) using, for example, a Fitz mill, corn mill, mortar and pestle, or a hammer mill.

The acceptable and preferred ranges of nonpolymeric resin (A), polymeric plasticizer (B), and colorants (C) are as follows:

| | Acceptable | Preferred | Most Preferred |
|---|---|---|---|
| Nonpolymeric Resin (A) | 50–98.5% | 70–90% | 73–84% |
| Polymeric Plasticizer (B) | 1–20 | 5–15 | 6–12 |
| Colorants (C) | 0.5–30 | 5–15 | 8–12 |

The completely kneaded blend of nonpolymeric resin (A), polymeric plasticizer (B), and colorants (C) will hereafter be referred to as colored predispersion (D).

In addition to the colored predispersion (D), the toner contains an aliphatic hydrocarbon carrier liquid (E) having a conductivity of $10^{-9}$ MHOS/cm or less, a dielectric constant of 3 or less, a flash point of 100° F. or greater, and, preferably, a viscosity of 5 cps or less.

The preferred organic solvents are generally mixtures of $C_9$–$C_{11}$ or $C_9$–$C_{12}$ branched aliphatic hydrocarbons. The liquid carrier (E) is, more preferably, a branched chain aliphatic hydrocarbons and more particularly Isopar G, H, K, L, M, and V. These hydrocarbon liquids are narrow cuts of isoparaffinic hydrocarbon fractions with extremely high levels of purity. For example, the boiling range of Isopar G is between 157° and 176° C., Isopar H between 176° and 191° C., Isopar K between 177° and 197° C., Isopar L between 188° and 206° C., Isopar M between 207° and 254° C., and Isopar V between 254.4° and 329.4° C. Isopar L has a midboiling point of approximately 194° C. Isopar M has a flash point of 80° C. and an auto-ignition temperature of 338° C. Stringent manufacturing specifications ensure that impurities, such as sulphur, acids, carboxyls, and chlorides, are limited to a few parts per million. They are substantially odorless, possessing only a very mild paraffinic odor. They have excellent odor stability and are all manufactured by the Exxon Corporation. High purity normal paraffinic liquids Norpar® 12, Norpar 13, and Norpar 15, also manufactured by Exxon Corporation, may be used. These hydrocarbon liquids have the following flash points and auto-ignition temperatures.

| Liquid | Flash Point (°C.) | Auto-Ignition Temp. (°C.) |
|---|---|---|
| Norpar 12 | 69 | 204 |
| Norpar 13 | 93 | 210 |
| Norpar 15 | 118 | 210 |

All of these liquid carriers have vapor pressures at 25° C. are less than 10 Torr. Isopar G has a flash point determined by the tag closed cup method of 40° C. Isopar H has a flash point of 53° C. determined by ASTM D 56. Isopar L and Isopar M have flash points of 61° C. and 80° C., respectively, determined by the same method. While these are the preferred dispersant nonpolar liquids, the essential characteristics of all suitable dispersant nonpolar liquids are the electrical volume resistivity and the dielectric constant. In addition, a feature of these liquid carriers is a low Kauri-Butanol value less than 30, preferably in the vicinity of 27 or 28, determined by ASTM D 1133.

The toner may also optionally contain a graft-type amphipathic copolymer (F). It is often desirable to use a graft-type amphipathic copolymer to aid the dispersion of the toner particles. Preferred amphipathic graft polymers are characterized as having a carrier soluble component and a grafted carrier insoluble component. The grafted insoluble component should preferentially adsorb on the surface of the toner particles. These types of polymers are described by Kosel (U.S. Pat. No. 3,900,412) and Tsubuko (U.S. Pat. No. 3,992,342) among others.

One particularly useful and preferred amphipathic copolymer can be prepared in the manner of Example XI of U.S. Pat. No. 3,900,412 in three steps as follows:

Part A—Copolymerize 3 wt. % glycidyl methacrylate with 97 wt. % lauryl methacrylate in Isopar H. The reaction temperature and monomer addition should be adjusted to produce a M.W. of about 40,000. About 0.5% azobisbutyronitrile can be used as an initiator.

Part B—Esterify about 25% of the oxirane groups from Part A with methacrylic acid to form pendant carbon-carbon double bond graft sites. All of the methacrylic acid should be esterified. Dodecyldimethylamine can be used as the esterification catalyst.

Part C—Polymerize about 8 wt. % of methyl methacrylate in the Presence of the Part B to give the resultant graft-type amphipathic copolymer.

In addition to giving superior dispersing properties, this preferred amphipathic copolymer also gives the toner particles strong, negative charges when maleic modified rosins are used as the nonpolymeric resin (A). Since the above polymer is essentially nonionic and is also a very weak base, its conductivity in Isopar H is very low (i.e., $<10^{-11}$ MHOS/cm at 1% solids). As such, it is not clear why the above preferred amphipathic copolymer gives the toners strong, negative charges having high mobilities with relatively high conductivities. It is believed that the above preferred amphipathic copolymer provides a local polar environment when absorbed on the toner surface which enables the deprotonation of some toner surface acid groups. In addition, there is evidence that the graft-type amphipathic copolymer solubilizes small fractions of the maleic modified rosin, leading to complex interactions between above preferred amphipathic copolymer, solubilized rosin, and the toner surface.

Another optional ingredient is an ionic or zwitterionic charge director (G) soluble in the carrier liquid.

Many are known in the art. Examples of negative charge directors include lecithin, basic calcium petronate, basic barium petronate, sodium dialkyl sulphosuccinate, and polybutylene succinimide, among many others. Examples of positive charge director agents include aluminum stearate, cobalt octoate, zirconium naphthenate, and chromium alkyl salicylate, among others.

Another optional ingredient is a carrier liquid insoluble charge adjuvant (H).

Charge adjuvants are used to improve the toner charging and mobility. This is especially true when using an ionic or zwitterionic-type charge director. It has been found that particularly useful negative charge adjuvants include carrier liquid insoluble phosphonated or sulfonated compounds, such as phosphoric acid. Examples of these types of charge adjuvants are described by Larson (U.S. Pat. No. 4,681,831) and Gibson (U.S. Pat. No. 4,891,286). Useful positive charge adjuvants include copolymers based upon vinyl pyridine or dimethylaminoethyl methacrylate, among others. Other types of charge adjuvants are known in the art and most may be used with the toners described herein.

Another optional ingredient is a wax (I). Toner redispersion properties can be improved somewhat by incorporating a small amount of wax into the toner during the ball milling step. The use of waxes for improving the toner redispersion properties are well-known in the art. However, it is not desirable to use more than 10 wt. % of wax as compared to the total toner solids or use more than 2 wt. % of wax as compared to the total liquid toner concentrate, otherwise both transparency and the toner concentrate viscosity will suffer. Particularly useful waxes include:

| | Melt Point (°F.) |
|---|---|
| Bayberry | 100–120 |
| Beeswax | 143.6–149 |
| Candelilla | 155–162 |
| Carnauba | 181–187 |
| Ceresine | 128–185 |
| Japan | 115–125 |
| Micro-crystalline | 140–205 |
| Montan | 181–192 |
| Ouricury | 180–184 |
| Oxidized microcrystalline | 180–200 |
| Ozokerite | 145–185 |
| Paraffines | 112–165 |
| Rice Bran | 169–180 |
| Spermaceti | 108–122 |

The colored predispersion (D); carrier liquid (E); and optional components (F), (G), (H), and (I) are usually blended together and finely ground by use of a suitable ball mill. The preferred ball mill is of the attritor type, for example, an S-1 Attritor available from Union Process Corp. of Akron, Ohio. However, other mills known in the art such as a pebble mill, vibration mill, sand mill, and the like, may also be used. The toner ingredients are normally ball milled at 20 to 50 wt % solids loading in the carrier liquid in order to prepare a high solids liquid toner concentrate. The goal of the ball milling step is to grind the colored predispersion (D) down to the following particle size ranges:

| | Acceptable | Most Preferred |
|---|---|---|
| Colored Predispersion (D) | 0.5 to 10 micron | 1 to 3 micron |

The lower limit of acceptable toner particle size is very dependent upon the average primary particle sizes of the colorant or pigment (C). An object of this invention is to significantly reduce or eliminate pigment interactions upon the toner charging and imaging properties. This is accomplished by encapsulating most, and preferably all, of the pigment surfaces within the toner particles. It is important that the minimum toner particle size be at least two times the average primary pigment particle size and preferably four times, or greater, than the average primary pigment particle size. A toner particle size in the 3 to 5 micron range is generally the upper limit for very high resolution imaging applications, although toner particle sizes up to 10 microns may be acceptable for many less demanding applications.

The acceptable and preferred ranges of solids as follows:

| | Acceptable Range | Preferred Range |
|---|---|---|
| Colored Predispersion (D) | 40–100% | 77–100% |
| Graft Amphipathic Copolymer (F) | 0–20 | 0–10 |
| Charge Director (G) | 0–5 | 0–1 |
| Charge Adjuvant (H) | 0–5 | 0–2 |

-continued

| | Acceptable Range | Preferred Range |
|---|---|---|
| Wax (I) | 0–30 | 0–10 |

After the ball milling step is completed, the toner is preferably diluted to 0.2 to 3 wt. % solids content in the carrier liquid for use in a printer or copier.

Liquid color toner compositions of the present invention have the following properties:

1. Charge properties which are stable over time.
2. Charge properties which are predictable and reproducible.
3. Charge properties which are not influenced by most pigments.
4. Charge properties which are similar for different color toners—in other words, colorblind.
5. Toner particles which are totally charged to one polarity, i.e., all particles are positively charged or all are negatively charged.
6. Toner particles suitable for developing known photoreceptors at low, medium, and high development speeds.
7. Toners suitable for use in known contact electrostatic transfer processes, i.e., give good transfer efficiency.
8. Toners suitable for use in gap electrostatic transfer processes such as those described by Bujese (U.S. Pat. No. 4,786,576).
9. Toners capable of imaging at least 5 to 95% halftone dots using a 150 line screen ruling.
10. Toners capable of imaging at least a 10 micron line resolution.
11. Process color toners capable of imaging at Specifications for Web Offset Printing (S.W.O.P.) image densities.
12. Color toners capable of producing images which have transparencies equal to, or better than, those obtained by offset printing inks.
13. Toners which are free-flowing at more than 40% solids concentration and are suitable for use in a high solids replenishment system.
14. Toners which redisperse easily upon settling.
15. Toners which do not film-form upon settling.
16. Toners capable of fusing below 100° C.
17. Toners capable of excellent adhesions to paper, metal, plastic, or glass surfaces.
18. Toners capable of of imaging on conductive fluoropolymer substrates using a gap electrostatic transfer process.
19. Toners capable of transferring completely from a fluoropolymer substrate to a paper, metal, or plastic substrate.

The liquid color toner composition is especially suitable for use in a gap transfer xero-printing process, such as that described in U.S. Pat. No. 4,786,576, which is incorporated herein by reference. This patent describes a method of fabricating a toned pattern on an electrically isolated nonabsorbent conductive receiving surface, comprising the steps of:

(a) establishing a charged electrostatic latent image area on an electrostatically imageable surface;

(b) developing the electrostatic latent image area by applying to the electrostatically imageable surface charged toner particles of a predetermined height suspended in a liquid comprised at least partially of a nonpolar insulating solvent to form a first liquid layer with a first liquid surface, the charged toner particles being directed to the latent image area of the electrostatically imageable surface to form a developed latent image;

(c) applying to the conductive receiving surface a liquid comprised at least partially of a nonpolar insulating solvent to form a second liquid layer with a second liquid surface;

(d) establishing an electric field between the electrostatically imageable surface and the conductive receiving surface by connecting a D.C. voltage directly to the conductive receiving surface;

(e) placing the conductive receiving surface adjacent to the electrostatically imageable surface so that a gap is maintained therebetween, and the first liquid surface contacts the second liquid surface to create a liquid transfer medium across the liquid-filled gap, the liquid-filled gap being of a depth greater than the height of the toner particles;

(f) transferring the developed latent image from the electrostatically imageable surface at a point of transfer through the liquid to the conductive receiving surface to form a transferred toner particle image in an imaged area and defined nonimaged area where toner particles are absent;

(g) maintaining the gap during transfer of the developed latent image between the electrostatically imageable surface and the conductive receiving surface at the point of transfer between at least about 1 mil and about 20 mils; and (h) fusing the transferred toner particles image to the conductive receiving surface.

Additionally, said process may include the following steps:

(a) etching the nonimaged areas of the conductive receiving surface to remove the conductive receiving surface from the nonimaged areas of the conductive receiving surface on the conductor laminate; and (b) removing the toner particles from the imaged area.

Furthermore, said process may employ a conductive fluoropolymer receiving surface and the steps of removing the carrier liquid and transferring the toner off of the fluoropolymer receiving surface to a second receiving surface such as paper by heat and pressure means.

COMPARISON AND EXAMPLES

The following Comparison and Examples are presented to define the invention more fully without any intention of being limited thereby. All parts and percentages are by weight and all temperatures are by degrees Celsius unless explicitly stated otherwise.

COMPARISON 1

A toner was prepared in two parts as follows:

| Part 1 | Weight (Grams) |
|---|---|
| (a) Colorant[1] | 200.0 |
| (b) Resin[2] | 1800.0 |

[1]Heliogen Blue D7072 available from BASF.
[2]Unirez 709 available from Union Camp.

These components were added into a sealable plastic container and mixed together by shaking for a few minutes. They were then added into the feed hopper of a twin screw compounding-type extruder (Baker-Perkins). The extruder temperature was adjusted to between 70° and 85° C., and the screw speed was adjusted to 170 rpm. A die with two 1/16 inch holes was fitted onto the extruder outlet. The feed hopper was turned on and the feed rate was adjusted to bring the extrusion torque between 2,000 and 4,000 Newton-meters. It took approximately 20 to 30 minutes to extrude the whole batch.

A small piece of the extruded material was smeared onto a hot microscope slide, cooled to room temperature, and viewed under a microscope. Very few large pigment particles (>1 micron) remained, and the dispersion appeared very homogeneous and transparent.

The remainder of the extruded batch was cooled to room temperature and then pulverized using a Fitz mill with an 0.0033 inch mesh screen. Part 1 now comprised a homogeneous powder with an average particle size of about 100 microns.

| Part 2 | Weight (Grams) |
|---|---|
| (a) Part 1 above | 250 |
| (b) Dispersing Agent[4] | 132 |
| (c) Amphipathic Copolymer[5] | 152 |
| (d) Liquid Carrier[6] | 595 |

[4]Neocryl S1004 available from Polyvinyl Corp., having a solids content of 50% in Isopar H solvent.
[5]A polymer made in the matter of Example XI of U.S. Pat. No. 3,900,412.
[6]Isopar H available from Exxon.

The Part 2 components were weighed into a 2 liter metal container. An S-1 type attritor (Union Process) containing 60 lbs. of 3/16 inch stainless steel balls was turned to its slowest speed, and the components were slowly added. The attritor cooling water was adjusted to 80° F., after which the mill speed was increased to 220 rpm for 3 hours.

After milling, a small batch sample was viewed under a microscope. The majority of the particles were in the 1-10 micron range and they were not flocculated. Carrier liquid Isopar H (564 grams) was added into the batch and mixed together for a few minutes. The mill concentrate was then removed from the attritor.

A 1% solids premix was prepared by diluting 125 grams of concentrate into 2,375 grams of Isopar G. The conductivity of the premix was measured using an Andeen-Hagerling 1 KHZ ultra-precision capacitance bridge with a Balsbaugh Labs cell. The premix charge to mass ratio (Q/M) was measured using a Fluke 412B high voltage power supply with a Keithley 610 LR electrometer and a Hunt P1-1B integrator. The Q/M cell consisted of two 4×4 inch tin oxide coated glass plates spaced a half inch apart. 1,000 volts d.c. were applied to the plates for two minutes, and the total electric charge (in coulombs) and the weight of deposited toner were recorded. The minimum fuse temperature was measured by recording the lowest temperature that the deposited toner on the Q/M plate fused into a clear transparent coating.

The optical density of the toner was measured using a MacBeth 2020PL color eye with a 1 cm transmission cell. The toner was diluted 1 part premix into 99 parts Isopar G for this measurement. The optical density (O.D.) was recorded at the wave length of nm maximum absorbance.

The premix was performance tested in a gap transfer xeroprinting device as described in U.S. Pat. No. 4,786,576, incorporated herein by reference. The photopolymer master consisted of Riston 215R (DuPont) laminated onto an aluminized polyester base. The master was exposed image-wise using 50 millijoules/CM$^2$ UV light for 30 seconds. The exposed master was installed and grounded in the xeroprinter, charged with a +6,500 volt corona, and then toned in a development station having a grounded electrode. The still wet toned image was next transferred off of the photopolymer master and onto an aluminized mylar surface through a 2 mil Isopar G filled gap using a transfer potential of +1,500 volts.

The toner of Comparison 1 produced extremely sharp images with 1 mil resolution, greater than 5% to 95% halftone capability with a 150 line screen, excellent image density, and good transfer off the master. No background imaging was noticed. The toner was nonflocculated and redisperses upon settling. However, the toner of Comparison 1 could not be heat fused into transparent images at reasonable temperatures (<120° C.) and was brittle with poor adhesion to all substrates. Table 1 shows the other properties.

TABLE 1

| COMPARISON 1 | | | | |
|---|---|---|---|---|
| Comparison | Conductivity at 1% Solids (pico MHOS/CM) | Q/M (Micro-Coul/g) | O.D./ nm Max. | Minimum Fuse Temp.°C. |
| 1 | 4.87 | 9.87 | 0.68/620 | >130 |

EXAMPLES 1 TO 6

Six toners were prepared and tested by the procedures as set forth in Comparison 1, except various molecular weight polyethylene glycol (PEG) plasticizers were incorporated into making the colored predispersion. 175 grams of plasticizer were used in each example. As with Comparison 1, all of the toners produced high resolution images. In addition, they also possessed excellent transparency and good adhesion. Other results are shown in Table 2.

TABLE 2

| EXAMPLES 1 TO 6 | | | | | |
|---|---|---|---|---|---|
| Example | MW of PEG Plasticizer | Conductivity at 1% Solids (pico MHOS/CM) | Q/M (Micro-Coul/g) | O.D./ nm Max. | Minimum Fuse Temp.°C. |
| 1 | 1,000 | 5.20 | 10.15 | 0.66/620 | 100 |
| 2 | 1,500 | 5.74 | 11.33 | 0.65/620 | 100 |
| 3 | 2,000 | 4.61 | 9.77 | 0.59/620 | 100 |
| 4 | 3,400 | 4.83 | 10.10 | 0.68/620 | 100 |
| 5 | 8,000 | 4.93 | 10.18 | 0.60/620 | 95 |
| 6 | 10,000 | 5.19 | 11.66 | 0.66/620 | 95 |

EXAMPLES 7 TO 42

The toners of Examples 7 to 42 were prepared using various pigments, described in Table 4, and having the following formula:

| Part 1 | Weight (Grams) |
|---|---|
| (a) Colorant[1] | 100 |
| (b) Resin[2] | 810 |
| (c) Plasticizer[3] | 90 |

[1]See Table 4.
[2]Unirez 709 (Union Camp).
[3]Polyethylene Glycol 10,000 (Aldrich).

The components of Part 1 were extruded and tested as in Comparison 1, but they were not Fitzmilled. Instead, the large extruded pieces were broken apart with a mortar and pestle.

| Part 2 | Weight (Grams) |
|---|---|
| (a) Part 1 above | 250 |
| (b) Dispersing Agent[4] | 132 |
| (c) Amphipathic Copolymer[5] | 152 |
| (d) Carrier Liquid[6] | 1159 |

[4]Neocryl S-1004, available from Polyvinyl Corp.
[5]A polymer prepared in the matter described in Example XI of U.S. Pat. No. 3,900,412.
[6]Isopar H, available from Exxon.

The Part 2 components were added into a Kady Mill high speed disperser equipped with a cooling water jacket. The batches were milled until the largest particles measured <100 microns using a Hegeman fineness of grind gauge. Total mill times were approximately 15 mins., and the batch temperatures were kept below 140° F.

The above Kady milled predispersions were Poured into S-1 attritors and milled for 3 hours by the Procedure as in Comparison 1.

The completed toners were tested by the procedure as set forth in Comparison 1. Additionally, the continuous phase contributions to conductivity and the Q/M of only the dispersed phase were measured. The continuous phase conductivity is a measure of the Isopar H soluble charge carriers which generally are not associated with the toner particles. This was determined by centrifuging the 1% solids premixes for at least 2 hours at 6,000 rpm and then measuring the conductivity of the supernatants. The percent continuous phase was calculated as follows:

$$\% \text{ In Continuous Phase} = \frac{\text{Continuous Phase Conductance}}{\text{Bulk Conductance}} \times 100$$

The Q/M of the dispersed phase is a measure of the total charge on the particles and is also related to the particle size distribution. This was determined by first making a plot of Q (from the Q/M cell) vs. conductivity (from the conductance cell). An Isopar soluble charge director (ASA-3 available from Shell) was used for the Q vs. Conductivity plot, and a Q/M electrometer showed very little change in current during the runs, indicating a very good solubility of the charge director. Table 3 shows the results:

TABLE 3

Q VERSUS CONDUCTANCE

| Concentration of ASA-3 in Isopar H | Q ($\times 10^{-6}$ Coul.) | Conductivity (pico MHOS/CM) |
|---|---|---|
| 6.4 ppm | 7.98 | 28.13 |

TABLE 3-continued

Q VERSUS CONDUCTANCE

| Concentration of ASA-3 in Isopar H | Q ($\times 10^{-6}$ Coul.) | Conductivity (pico MHOS/CM) |
|---|---|---|
| 2.9 ppm | 3.05 | 10.66 |
| 1.4 ppm | 1.07 | 3.86 |

A standard Q/M measurement was made on each toner at 1% solids by the procedure set forth in Example 1. From the measured continuous phase conductivity and the Q vs. Conductivity plot an estimate of the Q (continuous phase contribution) was made. The Q (dispersed phase contribution) was estimated by subtracting Q (continuous phase) from Q (Bulk). The Q/M of the dispersed phase was then measured as follows:

$$Q/M = \frac{Q \text{ (dispersed phase)} \times K}{\text{weight of toner (grams} \times 100)}$$

$$K = \text{Cell correction constant} = 1.3773$$

All of the toners in Examples 7 to 42 produced high resolution images with excellent transparency as in Examples 1-6. The minimum fusing temperatures were all in the 95° to 100° C. range and adhesion to glass, metal, and paper was excellent. Other results are shown in Table 5.

TABLE 4

PIGMENTS USED IN EXAMPLES 7 TO 42

| Example | C.I. Pigment No. | Trade Name | Manufacturer |
|---|---|---|---|
| 7 | P.Y. 17 | Sico Fast Yellow NBK 1265 | BASF |
| 8 | P.Y. 83 | Sico Fast Yellow NBK 1765 | BASF |
| 9 | P.Y. 13 | Sico Fast Yellow NBD 1375 | BASF |
| 10 | P.Y. 12 | Sico Yellow NBD 1442 | BASF |
| 11 | P.Y. 13 | Irgalite Yellow LBIW | Ciba-Geigy |
| 12 | P.O. 34 | Irgalite Orange FZG | Ciba-Geigy |
| 13 | P.R. 57 | Lithol Rubine NBD 4663 | BASF |
| 14 | P.R. 57 | Sunsperse Rubine | Sun |
| 15 | P.R. 57 | Irgalite Rubine L4BN | Ciba-Geigy |
| 16 | P.R. 53 | Lithol Red NBD-3560 | BASF |
| 17 | P.R. 53 | Sunbrite Red 5311 | Sun |
| 18 | P.R. 112 | Irgalite Red 3RS | Ciba-Geigy |
| 19 | P.R. 23 | Columbia Red 512 | Paul Uhlich |
| 20 | P.R. 81 | Rhodamine Y 6518 | Paul Uhlich |
| 21 | P.R. 81 | Fanal Pink D-4830 | BASF |
| 22 | P.R. 81 | Sunbrite Rhodamine Y | Sun |
| 23 | P.R. 81 | Rhodamine Y PTMA | Magruder |
| 24 | P.V. 1 | Rhodamine B-PMA | Magruder |
| 25 | P.V. 1 | Fanal Violet D-5480 | BASF |
| 26 | P.V. 3 | Fanal Violet D-6070 | BASF |
| 27 | P.V. 3 | Violet Toner VT8000 | Paul Uhlich |
| 28 | P.V. 23 | Permanent Violet VT2645 | Paul Uhlich |
| 29 | P.B. 15.3 | Heliogen Blue D7072 | BASF |
| 30 | P.B. 61 | Alkali Blue NBS-6157 | BASF |
| 31 | P.B. 1 | Hudson Blue BL3059 | Paul Uhlich |
| 32 | P.B. 1 | Victoria Blue SMA | Magruder |
| 33 | P.B. 2 | Peacock Blue 1095 | Paul Uhlich |
| 34 | P.B. 15:3 | Heliogen Blue D7080 | BASF |
| 35 | P.B. 15:3 | Sunfast Blue 15:3 | Sun |
| 36 | P.B. 15:3 | Irgalite Blue GLG | Ciba-Geigy |
| 37 | P.B. 15:3 | Irgalite Blue LG | Ciba-Geigy |
| 38 | P.G. 7 | Heliogen Green D-8730 | BASF |
| 39 | P.G. 7 | Sunfast Green 7 | Sun |
| 40 | P.G. 7 | Chromofine Green | Diacolor |
| 41 | P.G. 7 | Argyle Green GR0111 | Paul Uhlich |
| 42 | P.B. 7 | Mogul L | Cabot |

TABLE 5

EXAMPLES 7 TO 42

| Example | C.I. Pigment No. | Conductivity at 1% Solids (pico MHOS/cm) | Continuous Phase Conductivity % | Q/M Bulk Micro-C/g | Q/M Dispersed Phase Micro-C/g | O.D./ nm Max. | Q Bulk Micro-C/g | Toner Deposition (Grams) |
|---|---|---|---|---|---|---|---|---|
| 7 | P.Y. 17 BASF | 5.43 | 68 | 11.33 | 6.00 | 1.00/420 | 2.12 | 0.2459 |
| 8 | P.Y. 83 BASF | 3.57 | 56 | 8.53 | 5.96 | 0.85/460 | 1.64 | 0.2470 |
| 9 | P.Y. 13 BASF | 5.23 | 64 | 12.73 | 6.38 | 0.80/440 | 2.11 | 0.2502 |
| 10 | P.Y. 12 BASF | 5.64 | 68 | 13.22 | 6.30 | 0.90/440 | 2.23 | 0.2500 |
| 11 | P.Y. 13 CIBA-GEIGY | 4.26 | 69 | 12.60 | 6.20 | 0.81/440 | 2.00 | 0.2591 |
| 12 | P.O. 34 CIBA-GEIGY | 4.29 | 58 | 10.44 | 6.35 | 0.86/480 | 1.88 | 0.2539 |
| 13 | P.R. 57 BASF | 4.20 | 64 | 9.75 | 6.25 | 0.67/580 | 1.92 | 0.2536 |
| 14 | P.R. 57 SUN | 4.12 | 56 | 10.43 | 6.28 | 0.67/580 | 1.75 | 0.2401 |
| 15 | P.R. 57 CIBA-GEIGY | 4.47 | 69 | 10.91 | 6.22 | 0.70/580 | 1.98 | 0.2437 |
| 16 | P.R. 53 BASF | 3.95 | 62 | 8.31 | 6.01 | 0.57/540 | 1.79 | 0.2523 |
| 17 | P.R. 53 SUN | 3.54 | 60 | 8.14 | 6.00 | 0.64/540 | 1.73 | 0.2591 |
| 18 | P.R. 112 CIBA-GEIGY | 4.31 | 60 | 11.10 | 6.39 | 0.64/520 | 1.92 | 0.2474 |
| 19 | P.R. 23 PAUL UHLICH | 3.91 | 56 | 9.61 | 6.20 | 0.69/580 | 1.79 | 0.2597 |
| 20 | P.R. 81 PAUL UHLICH | 3.57 | 57 | 8.82 | 6.40 | 0.73/560 | 1.65 | 0.2315 |
| 21 | P.R. 81 BASF | 3.87 | 52 | 9.29 | 6.35 | 0.78/560 | 1.68 | 0.2408 |
| 22 | P.R. 81 SUN | 3.97 | 47 | 10.48 | 6.44 | 0.75/560 | 1.62 | 0.2333 |
| 23 | P.R. 81 MAGRUDER | 3.87 | 55 | 11.33 | 6.44 | 0.70/560 | 1.70 | 0.2343 |
| 24 | P.V. 1 MAGRUDER | 3.81 | 46 | 11.54 | 6.31 | 0.76/620 | 1.57 | 0.2339 |
| 25 | P.V. 1 BASF | 3.58 | 46 | 12.02 | 6.44 | 0.78/620 | 1.59 | 0.2403 |
| 26 | P.V. 3 BASF | 3.61 | 53 | 9.17 | 6.30 | 0.89/620 | 1.69 | 0.2520 |
| 27 | P.V. 3 PAUL UHLICH | 3.67 | 65 | 9.05 | 6.13 | 0.86/620 | 1.59 | 0.2307 |
| 28 | P.V. 23 PAUL UHLICH | 3.53 | 68 | 8.51 | 5.97 | 0.81/560 | 1.74 | 0.2436 |
| 29 | P.B. 15:3 BASF | 3.84 | 60 | 9.09 | 6.18 | 0.67/620 | 1.78 | 0.2524 |
| 30 | P.B. 61 BASF | 4.77 | 53 | 12.20 | 6.34 | 0.74/620 | 1.81 | 0.2360 |
| 31 | P.B. 1 PAUL UHLICH | 3.72 | 46 | 9.75 | 6.27 | 0.77/640 | 1.59 | 0.2414 |
| 32 | P.B. 1 MAGRUDER | 5.16 | 69 | 12.16 | 6.07 | 0.70/640 | 2.15 | 0.2592 |
| 33 | P.B. 2 PAUL UHLICH | 4.01 | 50 | 11.09 | 6.41 | 0.60/660 | 1.64 | 0.2302 |
| 34 | P.B. 15:3 BASF | 3.88 | 58 | 9.72 | 6.11 | 0.84/620 | 1.66 | 0.2309 |
| 35 | P.B. 15:3 SUN | 3.57 | 67 | 8.70 | 6.03 | 1.12/620 | 1.74 | 0.2421 |
| 36 | P.B. 15:3 CIBA-GEIGY | 3.79 | 62 | 10.69 | 6.15 | 0.76/620 | 1.80 | 0.2531 |
| 37 | P.B. 15:3 CIBA-GEIGY | 3.65 | 68 | 9.98 | 6.03 | 0.67/620 | 1.74 | 0.2346 |
| 38 | P.G. 7 BASF | 4.14 | 57 | 10.53 | 6.07 | 0.70/420 | 1.76 | 0.2475 |
| 39 | P.G. 7 SUN | 3.79 | 47 | 8.81 | 6.13 | 0.69/420 | 1.67 | 0.2598 |
| 40 | P.G. 7 DIACOLOR | 5.58 | 68 | 13.00 | 6.10 | 0.74/420 | 3.67 | 0.2360 |
| 41 | P.G. 7 PAUL UHLICH | 5.60 | 70 | 13.00 | 6.17 | 0.70/420 | 2.23 | 0.2494 |
| 42 | P.B. 7 CABOT | 4.74 | 68 | 12.95 | 6.24 | 0.83/580 | 1.97 | 0.2325 |

EXAMPLE 43

A toner was prepared and tested exactly by the Procedure for the toners of Examples 7 to 42, except the Part 2 mill concentrate was made at 40% solids instead of 20% solids as follows:

| | Weight (Grams) |
|---|---|
| Part 1[1] | 354.2 |
| Dispersant[2] | 187.0 |
| Amphipathic Copolymer[2] | 215.3 |
| Carrier Liquid[2] | 443.4 |

[1]Same as in Example 29 (pigment is Heliogen Blue D7072).
[2]Same as in Examples 7 to 42.

The toner concentrate flowed freely at 40% solids and had a viscosity in the 300 cps range. The 40% solids concentrate was placed in a Savin 5030 copier toner replenishment bottle equipped with a valve and allowed to sit one month undisturbed with the valve side down. After one month, the toner concentrate still flowed easily and did not clog the valve. The toner could easily be diluted directly from a 40% concentrate into an approximately 1% solids developer premix bath with no noticeable flocculation or agglomeration.

The imaging properties of the toner of Example 43 are virtually identical to those of the toners of Examples 7 to 42. Table 6 shows the other properties:

TABLE 6

EXAMPLE 43

| Conductivity at 1% Solids (pico MHOS/cm) | % Continuous Phase Conductivity | Q/M Bulk (Micro-C/g) | Q/M Dispersed Phase Micro-Coul/g) | Q Bulk (Micro-Coul/g) | Toner Q/M Deposition (Grams) | O.D./nm |
|---|---|---|---|---|---|---|
| 3.86 | 57% | 10.65 | 6.06 | 1.68 | 0.2396 | 0.80/620 |

EXAMPLE 44

To demonstrate toner color blending ability, 1,250 g of the pigment of Example 11 was blended with 1,250 g of the pigment of Example 29 to produce a green shade toner blend. Each toner and the blend were in a diluted (1% solids) working bath premix form. The blended toner was next added to a Savin 5030 liquid toner copier and 700 copies of an 8% coverage test pattern were made with no replenishment of the toner bath. This depleted about 80% of the toner solids in the premix. The depletion caused a continuous drop in image densities throughout the run making it very difficult to colorimetrically compare the first print with a "depleted toner" print and relate this to hue differences. To get around this, the toner bath had to be monitored off-line. Specifically, at 100 copy intervals, the toner was transferred into a plating cell normally used for Q/M testing.

Paper was taped over the anode and toner was plated directly onto the paper. The toned paper was next dried and fused with a heat gun. To give constant image densities, plating time was increased according to bath depletion. The toner bath absorbance was also monitored at 100 copy intervals at 420 nm and 0.01 dilution in Isopar H. Before the print test, a plot of blended toner bath absorbance vs. plating time was made at an approximately constant 1.20 image density.

After the print test, each plated color "swatch" was measured in CIE L*a*b* color space using a MacBeth 2020PL color-eye. To monitor only the hue differences, L (lightness) values were kept within ±0.1 for each data point. The total color difference (dE) was recorded for each data point as compared with the start. Total color difference is defined as:

$$dE = \sqrt{(\Delta L)^2 + (\Delta a)^2 + (\Delta b)^2}$$

A dE <1 is generally not perceived as a color difference by most people. Table 7 shows that the dE was less than one throughout the 700 copy run which indicates that both of the blended toners depleted virtually at the same rate. Visually, no significant color difference was noticed in any of the color swatches. This example also demonstrates the feasibility of using these toners with a contact transfer process, e.g., Savin copier.

TABLE 7

EXAMPLE 44

| Copy No. | Developer Absorbance* | Plating Time (sec.) | L* | a* | b* | dE |
|---|---|---|---|---|---|---|
| Start | 0.61 | 15 | 50.77 | −45.12 | 17.94 | — |
| 100 | 0.50 | 25 | 50.73 | −45.50 | 17.83 | 0.36 |
| 200 | 0.40 | 38 | 50.72 | −45.28 | 18.02 | 0.19 |
| 300 | 0.31 | 50 | 50.79 | −45.07 | 17.52 | 0.42 |
| 400 | 0.27 | 56 | 50.79 | −45.14 | 17.57 | 0.37 |
| 500 | 0.22 | 61 | 50.78 | −44.73 | 17.50 | 0.59 |
| 600 | 0.18 | 65 | 50.71 | −44.43 | 17.43 | 0.86 |
| 700 | 0.13 | 72 | 50.79 | −44.42 | 17.26 | 0.98 |

*0.01 dilution in Isopar H.

EXAMPLE 45

A liquid toner was prepared in two parts, as follows:

| Part 1 | Weight (Grams) |
|---|---|
| (a) Colorant[1] | 600 |
| (b) Resin[2] | 4,920 |
| (c) Plasticizer[3] | 480 |

[1]Heliogen Blue D7072 available from BASF.
[2]Unirez 709 available from Union Camp.
[3]Polyethylene Glycol 8000 available from Union Carbide.

The above colored predispersion was compounded and tested according tot he procedures in Examples 7 to 42.

| Part 2 | Weight (Grams) |
|---|---|
| (d) Part 1 from above | 327 |
| (e) Amphipathic Copolymer[1] | 149 |
| (f) Wax[2] | 26 |
| (g) Carrier Liquid[3] | 999 |

[1]Same as in Examples 7 to 42.
[2]Carnauba wax available from Frank B. Ross Co.
[3]Isopar H available from Exxon Corporation.

The Part 2 toner concentrate was Kady milled for 15 minutes while maintaining the batch temperature below 100° F. The contents were next transferred into an S-1 type attritor and were milled for 4 hours at 100° to 110° F. batch temperature. After 4 hours milling, the batch temperature was reduced to 75° F. and milling was continued for one additional hour. The mill speed was adjusted to 250 rpm throughout the run. 1,001 grams of Isopar H were added into the mill just prior to draining the toner concentrate.

The above concentrate was diluted to 1% solids (i.e., 167 grams concentrate into 2,333 grams of Isopar H) and tested according to the procedures in Examples 7 to 42. Testing showed:

| Conductivity at 1% Solids (pico MHOS/cm) | % Continuous Phase Conductivity | Q/M Bulk (Micro-C/g) |
|---|---|---|
| 3.98 | 56% | 11.85 |

The imaging properties were very similar to those in Examples 7 to 42. In addition, this toner was noticeably easier to redisperse upon settling compared to toners not containing the wax.

The toner was plated onto an SnO glass Q/M plate and fused at 100° C. for about 5 minutes. The transparency of the fused toner was comparable to a cyan offset ink (VanSon Process Blue) which was smeared onto a similar glass plate. However, a cyan toner not containing any wax (Example 29) is more transparent than either of the above. This indicates that only small amounts of wax should be used or transparency may deteriorate.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other Publications cited herein are incorporated by reference in their entirety.

What is claimed is:

1. A liquid toner composition comprising:

(a) a colored predispersion comprising a homogeneous mixture of at least one nonpolymeric resin material, at least one polymeric plasticizer, and at least one colorant material;

(1) said nonpolymeric resin material characterized by:

(aa) being insoluble and nonswellable in the liquid carrier;

(bb) having a melting point between 60° to 180° C.; and (cc) having an acid number higher than about 100;

(2) said polymeric plasticizer characterized by:

(aa) being soluble in said nonpolymeric resin;

(bb) being insoluble in the liquid carrier;

(cc) having a melting point from about 35° C. to about 70° C; and (3) said colorant material having an average primary particle size of less than about 0.5 microns;

and wherein said colored predispersion contains about 50% to about 98.5% by weight nonpolymeric resin; about 1.0% to 20% by weight polymeric plasticizer; and 0.5% to 30% by weight colorant material; and (b) an aliphatic hydrocarbon carrier liquid having a conductivity of $10^{-9}$ MHOS/$_{cm}$ or less, a dielectric constant of 3 or less, and a flash point of 100° F. or greater; wherein said toner containing about 0.1% to about 10% by weight colored predispersion and about 99.9% to about 90% by weight of said liquid carrier and said colored predispersion Particles having about 0.5-10 micron average particle size and being insoluble and nonswellable in said liquid carrier.

2. The liquid toner of claim 1 wherein said nonpolymeric resin is a maleic modified rosin.

3. The liquid toner of claim 1 wherein said polymeric plasticizer is a polyethylene glycol having a molecular weight from about 1,000 to about 10,000.

4. The liquid toner of claim 1 wherein said colorant material is a pigment material.

5. The liquid toner of claim 1 wherein said colored predispersion comprises a homogeneous mixture of a maleic modified rosin, a polyethylene glycol having a molecular weight from about 1,000 to about 10,000, and a pigment material.

6. The liquid toner of claim 5 wherein said maleic modified rosin is about 70% to about 90% by weight of the colored predispersion.

7. The liquid toner of claim 6 wherein said polyethylene glycol having a molecular weight from about 1,000 to about 10,000 is about 5% to about 15% by weight of the colored predispersion.

8. The liquid toner of claim 6 wherein said organic or inorganic pigment material is from about 5% to about 15% by weight of said colored predispersion.

9. The liquid toner of claim 1 wherein said liquid toner additionally contains a graft amphipathic copolymer in an amount from 0% to about 20% by weight of the solids of said liquid toner.

10. The liquid toner of claim 1 wherein said liquid toner additionally contains a ionic or zwitterionic charge director soluble in said liquid carrier in an amount from 0% to about 5% by weight of the solids of said liquid toner.

11. The liquid toner of claim 1 wherein said liquid toner additionally contains a charge adjuvant in the amount from 0% to about 5% by weight of the solids content of said toner.

12. The liquid toner of claim 1 wherein said liquid toner additionally contains a wax in the amount from about 0% to about 30% by weight of the solids content of said toner.

13. The liquid toner of claim 1 wherein said solids content of said liquid toner is from about 0.2% to about 3% by weight.

14. A liquid toner concentrate composition comprising:

(a) a colored predispersion comprising a homogeneous mixture of at least one nonpolymeric resin material, at least one polymeric plasticizer, and at least one colorant material;

(1) said nonpolymeric resin material characterized by:

(aa) being insoluble and nonswellable in the liquid carrier;

(bb) having a melting point between 60° to 180° C.; and (cc) having an acid number higher than about 100;

(2) said polymeric plasticizer characterized by:

(aa) being soluble in said nonpolymeric resin;

(bb) being insoluble in the liquid carrier;

(cc) having a melting point from about 35° C. to about 70° C.; and (3) said colorant material having an average primary particle size of less than about 0.5 microns;

and wherein said colored predispersion contains about 50% to about 98.5% by weight nonpolymeric resin; about 1.0% to 20% by weight polymeric plasticizer; and 0.5% to 30% by weight colorant material; and (b) an aliphatic hydrocarbon carrier liquid having a conductivity of $10^{-9}$ MHOS/$_{cm}$ or less, a dielectric constant of 3 or less, and a flash point of 100° F. or greater;

wherein said toner concentrate containing about 20% to about 50% by weight solids and about 80% to about 50% by weight of said liquid carrier and said colored predispersion particles having about 0.5-10 micron average particle size and being insoluble and nonswellable in said liquid carrier.

* * * * *